US007407086B2

(12) United States Patent
Borio

(10) Patent No.: US 7,407,086 B2
(45) Date of Patent: Aug. 5, 2008

(54) BASE FOR DISPLAY UNITS, FOR INSTANCE DISPLAY UNITS FOR FOOD PRODUCTS

(75) Inventor: Pierangelo Borio, Alba (IT)

(73) Assignee: Soremartec S.A., Arlon-Schoppach (BE)

( * ) Notice: Subject to any disclaimer, the term of this patent is extended or adjusted under 35 U.S.C. 154(b) by 42 days.

(21) Appl. No.: 11/458,525

(22) Filed: Jul. 19, 2006

(65) Prior Publication Data

US 2007/0046810 A1 Mar. 1, 2007

(30) Foreign Application Priority Data

Aug. 30, 2005 (IT) ..... TO2005A0593

(51) Int. Cl.
*B65D 5/32* (2006.01)

(52) U.S. Cl. ..... 229/101; 248/174; 206/736

(58) Field of Classification Search ..... 248/188.1, 248/174; 206/736, 756, 758, 761, 764, 765, 206/774; 229/101, 103
See application file for complete search history.

(56) References Cited

U.S. PATENT DOCUMENTS 1,680,539 A * 8/1928 Hadi ..... 206/761
1,985,516 A 12/1934 Parr et al.
2,051,512 A * 8/1936 Bergquist ..... 206/761
4,049,113 A * 9/1977 Joyce et al. ..... 206/45.22
5,333,777 A * 8/1994 Roth ..... 229/117.16

FOREIGN PATENT DOCUMENTS

| | | | |
|---|---|---|---|
| DE | 3411491 | A1 | 10/1985 |
| DE | 9006016 | U1 | 9/1991 |
| FR | 416749 | A | 10/1910 |
| FR | 1358615 | A | 4/1964 |

* cited by examiner

*Primary Examiner*—Anita M King
(74) *Attorney, Agent, or Firm*—Rothwell, Figg, Ernst & Manbeck, P.C.

(57) ABSTRACT

A base for display units that can be made as a product of the paper-transformation industry including a box-like body with a lateral wall that extends between a bottom part and a top part. The base also includes a wall on which rests a display unit selectively mobile between:

a lowered position in which the mobile wall is situated in correspondence with said bottom part, and the base is capable of acting as a container for a display unit, and a raised position in which the mobile wall is situated in correspondence with the top part of the base and is capable of supporting a display unit in the exhibiting position.

6 Claims, 4 Drawing Sheets

BASE FOR DISPLAY UNITS, FOR INSTANCE DISPLAY UNITS FOR FOOD PRODUCTS

BACKGROUND OF THE INVENTION

1. Field of the Invention

The present invention relates to bases for display units.

2. Description of the Related Art

The invention was developed with particular attention to its possible use in conjunction with display units used to exhibit foodstuffs such as confectionery at points of sale.

A current practice entails the production of bases of this type in the form of products of the paper-transformation industry. Substantially speaking these are boxes of cardboard or similar material, generally having the shape of a parallelopiped, destined to stand on the ground and provided with an upper plane on which a display unit is placed (generally of the type with a number of shelves) on which the exhibited products are placed.

The purpose of the base is to maintain the display unit and the products that are on it in an easily visible and accessible position: it is considered undesirable for products to be located close to the floor, a position that also makes the operation of removing the products from the display unit inconvenient.

It is equally general practice to send the unit formed of the display unit (usually with the products already situated inside it) and the relative base to the places of exhibition and sale, as a unit already assembled and mounted. For this purpose, the display units mounted on their respective bases are loaded onto pallets so that they can easily be handled in groups of four or more units.

An intrinsic drawback connected with this solution lies in the fact that the base of the display unit is in the form of a body having rather considerable dimensions, but whose internal volume is completely unutilised. To use an expression widely used in the sector—this solution in practice translates into the operation of "transporting air": a considerable part of the volume of the load of each pallet is occupied by cavities that are not utilised.

To avoid or at least to mitigate this drawback, a known and practised solution is to employ display units that can be taken apart, that are sent to the place of exhibition in a folded condition, after which they are mounted and receive the products in a subsequent loading operation of the mounted display unit.

Apart from all other considerations, this solution is not appreciated by those who must mount and load the display units at the place of exhibition. The operation of mounting the display unit may in some cases be fairly complicated for an operator who is not particularly expert. In any case, it is inevitable, as the final phase of setting up, that the products—which are transported to the place of exhibition separately, and thus inefficiently—must be loaded into the display unit.

When the display unit has completed its function, the problem arises of taking the display unit apart and disposing of it, including the base. This operation may be particularly hard above all if the display unit (and the base supporting it) are made of mixed materials, destined to follow different channels in the context of differentiated waste collection.

SUMMARY OF THE INVENTION

The present invention has the object of producing a base for display units of the type specified above such as to be free of the drawbacks outlined above.

According to the present invention, this object is achieved thanks to a base for display units having the characteristics related specifically in the attached claims.

The claims form an integral part of the disclosure of the invention provided herein.

The solution described herein resolves the various problems outlined in the introductory part of this description in an ideal manner, giving rise to a base that, during the transport phase of display units and products towards the place of exhibition, is capable of acting as a container. In this way it is possible to avoid "transporting air", at the same time making available a base that is capable of being put into the condition of use through a sequence of operations capable of being carried out rapidly and safely including by an operator who is not particularly expert. Apart from this, the base according to the invention, in the embodiment at present preferred, takes the form of a single product of the paper-transformation industry capable of easily being disposed of through the differentiated channels for the collection of paper.

BRIEF DESCRIPTION OF THE DRAWINGS

The invention will now be described, as a simple example without limiting intent, with reference to the attached drawings, in which.

DETAILED DESCRIPTION OF THE INVENTION

Figure 1:
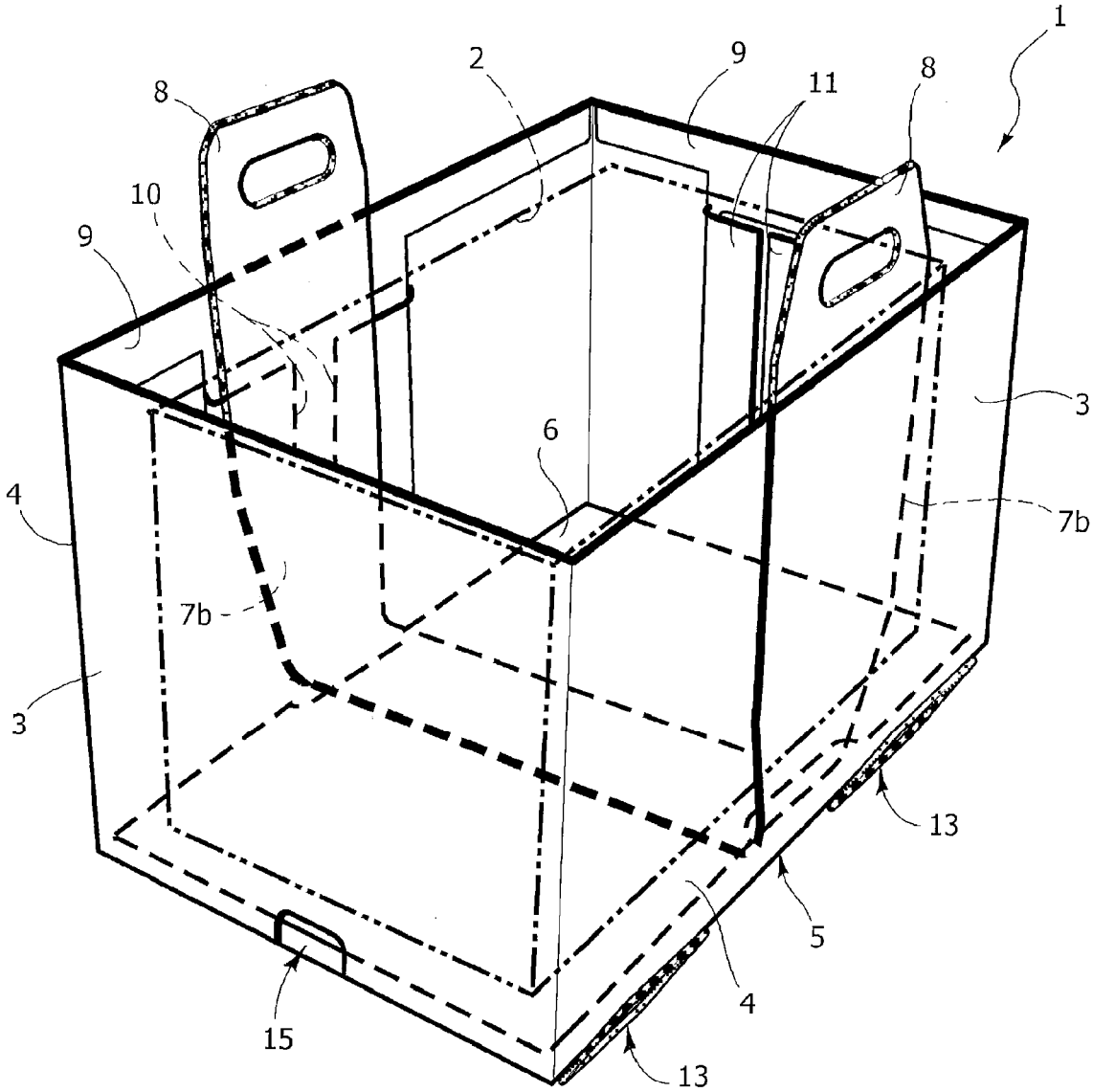
FIG. 1 is a first perspective view of a base for display units according to the invention, illustrated in the position in which it can be used to transport a display unit and products towards the place of exhibition.

In the attached drawings, the numerical reference 1 indicates overall a base for use as a base for display units of foodstuffs such as, for example, confectionery.

The base 1 described here can be used in conjunction with display units of any type, shape and appearance. As an example, the use is illustrated here of the base 1 in combination with a display unit 2 (whose profile is represented in diagram form with dotted lines) comprising—for example—a shelf unit comprising a plurality of shelves on which boxes of chocolates or similar products are destined to be placed.

In the embodiment at present preferred, the base 1 is made as a product of the paper-transformation industry and presents, again in the embodiment at present preferred (and thus what is said here should not be interpreted in a limiting sense with regard to the scope of the invention) as a box of right rectangular parallelepiped form presenting a lateral part with two smaller lateral faces 3 and two larger lateral faces 4 opposed in pairs.

For preference (but not imperatively) the box-like structure of the base 1 also includes a bottom wall 5.

A significant characteristic of the solution described herein is the presence, inside the box-like body of the base 1, of a wall 6 (usually a continuous structure, but capable if required of presenting a discontinuous structure, for example with openings, in grid form, etc.) which is configured as a wall mobile vertically inside the structure of the base 1.

In the embodiment at present preferred, the mobile wall 6 has an overall rectangular shape and dimensions approximately corresponding to (but in fact slightly smaller than)

those of the bottom wall 5 (and thus of the transversal horizontal section) of the box-like body of the base 1.

In the condition represented in FIG. 1, the wall 6 is situated in a lowered position, in which the mobile wall 6 is in the immediate vicinity (and in fact resting upon) the bottom wall 5.

The mobile wall 6 may thus be made to slide in a vertical direction (conserving its general horizontal orientation) towards a raised position (represented in FIG. 4) in which the wall 6 is in proximity with the upper edges of the lateral walls 3, 4 of the box-like body of the base 1.

Figure 4:
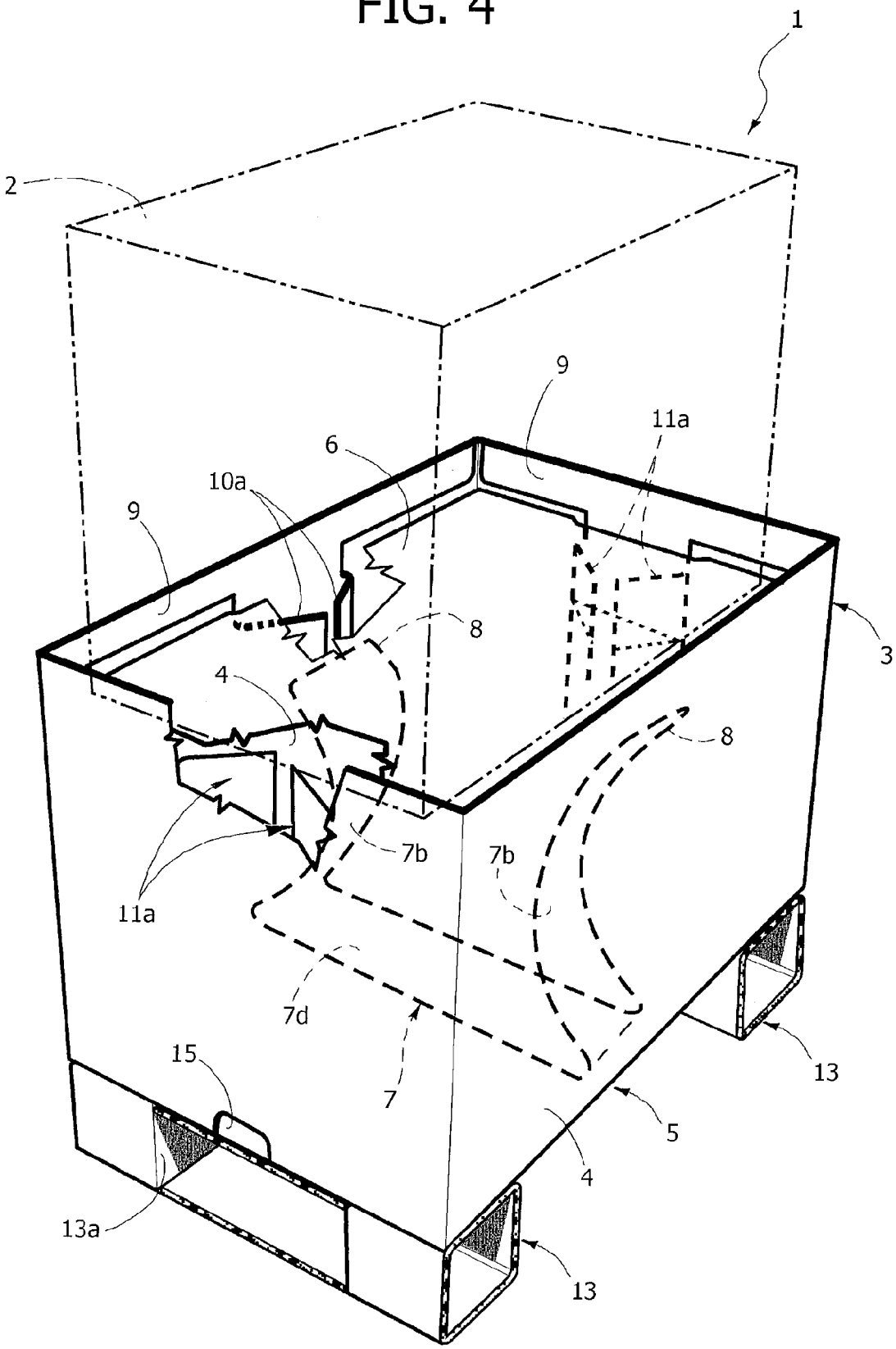
FIG. 4 is a general perspective view of the base according to the invention illustrated in its typical condition of use.

It is possible to achieve raising of the mobile wall 6 between the lowered position of FIG. 1 and the raised position of FIG. 4, by acting on a traction element comprising, in the embodiment illustrated as an example here, a strip 7 of product of the paper-transformation industry (typically cardboard) folded into a general U-shaped formation.

In particular, the strip 7 comprises a central base or core portion 7*d* that extends beneath the mobile wall 6 (above the bottom wall 5) and two lateral branches 7*b* that extend in the vertical direction along the two side walls (in the example illustrated here, the two larger side walls 4) of the structure of the base 1. The two lateral branches 7*b* terminate at their upper extremities in two grip formations of the handle type 8.

The overall length of the lateral branches 7*b* of the strip 7 is selected so that, when the mobile wall 6 is in the lowered position in FIG. 1, the handles 8 project above the upper edges of the side walls 3, 4 of the box-like body of the base 1, so that they can be grasped from the outside.

Figure 3:
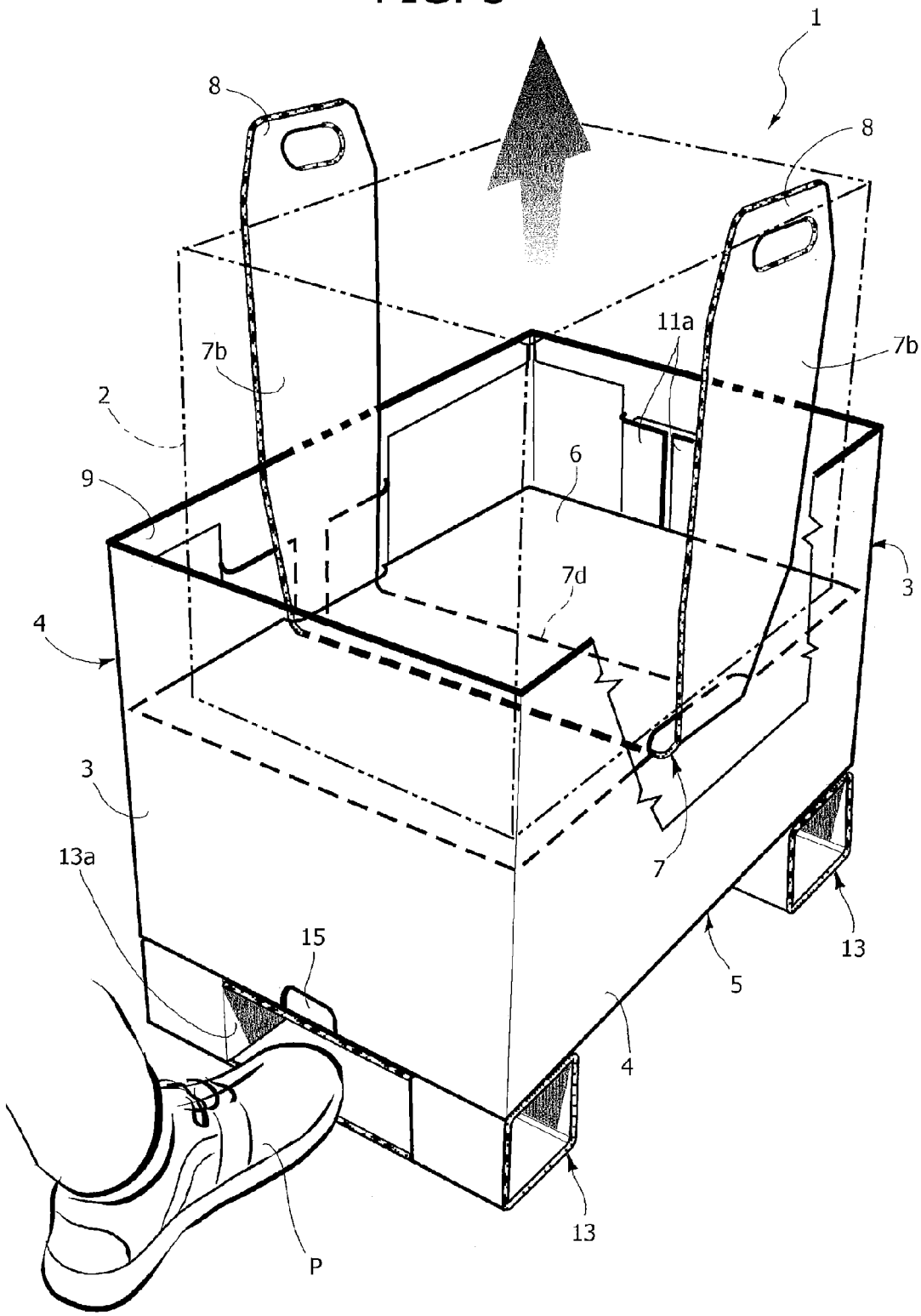

As is illustrated in diagram form in the sequence of FIGS. 1, 3 and 4, the person mounting the base 1 may act on the handles 8 pulling them upwards so as to gradually cause the mobile wall 6 to be raised from the lowered position in FIG. 1 to the raised position in FIG. 4.

It will be appreciated that this movement may easily be performed including in the presence of the display unit 2 placed above the mobile wall 6 inside the box-like structure of the base 1. In the condition represented in FIG. 1, the base is thus capable of acting as a container for the display unit 2 and the products—already in position for exhibition—placed on the display unit 2.

The movement of raising the base 6 from the lowered position of FIG. 1 to the raised position of FIG. 4 is facilitated by the fact that the dimensions of the mobile wall 6 are chosen so as to create some lateral play with regard to the inner surface of the lateral wall 3, 4 of the box-like structure of the base 1.

In correspondence with their upper extremities, the lateral walls 3, 4 of the base 1 present parts 9 folded inwards with regard to the cavity of the base so as to create formations that halt the raising the movement of the mobile wall 6. In this way it is avoided that, due to the raising action, the base 1 may be extracted in an undesired manner from the structure of the base 1.

The numerical references 10 and 11 indicate flap formations (usually present as pairs of homologous formations) provided in an approximately central position on the inner surface of the lateral walls 3, 4 of the box-like structure of the base 1. When the base 1 is acting as a box (that is in the condition represented in FIG. 1) the said flap formations 10 and 11 are pressed against the lateral walls 3, 4 by the peripheral edge of the mobile wall 6.

During the raising movement, the peripheral edge of the mobile wall 6 brushes with its edge against the flaps 10 and 11, which extend in a substantially vertical direction. The overall length of the flaps 10, 11 is selected so that their upper extremities 10*a*, 11*a* are slightly below the position in which the raising movement of the mobile wall 6 is halted, defined by the folded formations 9.

Once the raising movement achieved by acting on the handles 8 has been completed, the mobile wall 6 has completed its raising movement and is brought to a stop against the folded formations 9. Then, the flaps 10 and 11—no longer held in place by the edge of the mobile wall 6—move elastically inwards with regard to the cavity of the base 1 so as to come into a condition of interference with the trajectory of movement of the mobile wall 6.

In a preferential (but not imperative) fashion, a further flap having an approximately horizontal edge linked to the respective lateral wall of the base 1 is also associated to the upper extremities 10*a*, 11*a* of the flaps 10, 11.

When the base 1 is acting as a box, this further flap is also pressed against the lateral walls 3, 4 by the flaps 10, 11 in their turn pressed by the peripheral edges of the mobile wall 6 (see FIGS. 1 and 3, top left, where parts of the distal portion of one of these further flaps may be seen emerging upwards between the upper extremities 11*a* of two flaps 11).

As has been said, once the raising movement of the mobile wall 6 has been completed, the flaps 10 and 11 move elastically inwards with regard to the cavity of the base 1 so as to come into a condition of interference with the movement trajectory of the mobile wall 6. At the same time the further flap between them (if present) assumes a downward orientation rotating with respect to the horizontal proximal edge linked to the respective lateral wall of the base 1 and thus acts as a wedge between the two vertical flaps 10 or 11 (see FIG. 4, top left, where the further flap in question—shown in dotted lines—extends horizontally between the two flaps 11, maintaining them at a precise distance from the wall of the base 1, so that they can solidly support the mobile wall 6.

More precisely (see again in particular FIG. 4) the mobile wall 6 rests on the upper extremities 10*a*, 11*a* of the flaps 10, 11. The wall 6 is thus solidly blocked in the raised position and cannot be made to descend inside the base unless (with a positive action that cannot take place accidentally) the flaps 10 and 11 are both simultaneously brought into position against the peripheral walls 3, 4 of the box-like structure of the base 1.

In the raised position, the mobile wall 6 supported by the upper extremities 10*a*, 11*a* of the flaps 10, 11 constitutes a solid supporting base that holds the display unit 2 extracted from the base 1 in its raised position to exhibit the products.

The raising strip 7 may in this conditions be made to descend again downwards, with the further possibility of pushing the handles 8 into the base 1 below the mobile wall 6, a condition in which the handles are hidden from sight (see FIG. 4).

Preferentially, foot-like formations 13 are provided at the lower extremity of the base 1 (in the embodiment illustrated herein as an example, in correspondence with the bottom wall 5) destined to maintain the base 1 with its lower portion detached from the ground, so as to enable the display unit to be transported with a fork lift truck.

Figure 2:
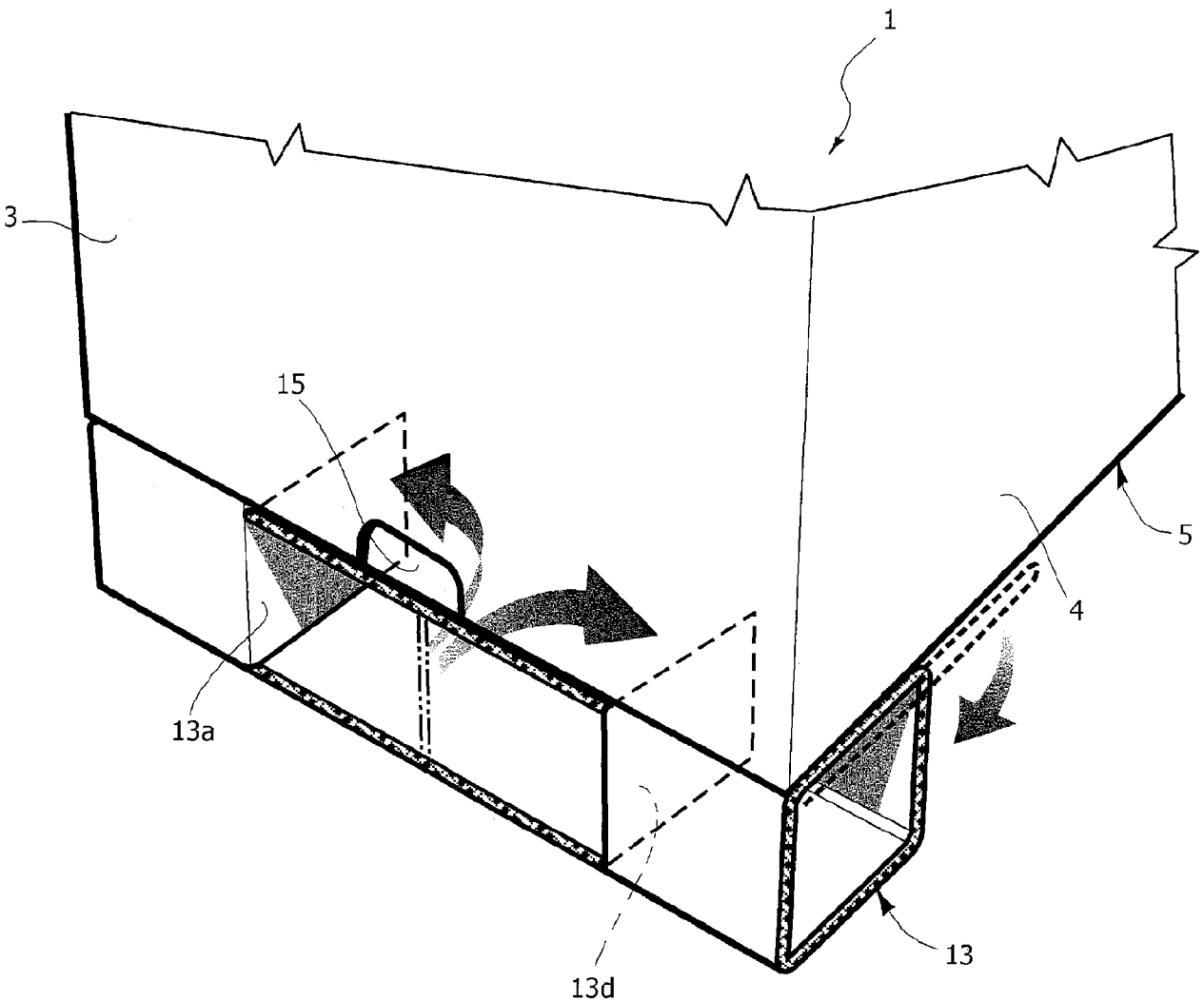
FIGS. 2 and 3 illustrates two successive phases in the mounting operation of the base according to the invention.

As is more clearly visible in the representation in FIG. 2, in the embodiment illustrated here as an example, the foot-like formations 13 each comprise a box-like tube of a product of the paper-transformation industry with a square or rectangular section capable of being selectively moved between a flattened position (represented in FIG. 1) and a deployed position (illustrated in FIG. 2) in which each foot 13 may then be blocked by folding a pair of flaps 13*a* and 13*d* into the cavity of the tubular structure, these flaps being cut out of the outer wall (with respect to the base 1) of each foot-like structure 13.

The operation of folding the flaps 13*a* and 13*d* into the tubular structure of each foot 13 presents the further advantage of creating, within each foot 13, a cavity opening towards the outside of the base that enables the person mounting the base 1 of the display unit 2 to insert his or her foot P so as to exercise a solid recall action holding the base 1 against the ground, thus avoiding any undesired raising movement while the mobile wall 6 and the display unit 2 within it are raised upwards, towards the position represented in FIG. 4.

Reference 15 lastly indicates two cavities usually provided in the smaller lateral walls 3 in correspondence with the bottom wall 5. The cavities 15 are destined to facilitate grasping and lifting the base 1 in the condition represented in FIG. 1 in which it acts as a container for the display unit 2 and the products that are inside it.

Once the display unit 2 has completed its function, the base 1 described may either be used as a base to support another display unit, or may easily be folded and disposed of as waste products of the paper-transformation industry through the normal channels of differentiated collection of paper and similar products.

Naturally, the principle of the invention holding good, the construction details and the embodiments may be widely varied with regard to what is described and illustrated here, without thereby departing from the scope of the invention, as is defined in the attached claims.

The invention claimed is:

1. Base for display units comprising a box-shaped body with a lateral wall extending between a bottom part and a top part of said box-shaped body, the base also including a mobile wall to support said display units selectively mobile between:

a lowered position, in which said mobile wall is situated in correspondence with said bottom part and said base is capable of acting as a container for a display unit, and a raised position in which said mobile wall is situated in correspondence with said top part and is capable of supporting a display unit in the exhibiting position, said base further comprising a raising structure for raising said mobile wall provided with at least one grip formation to raise said mobile wall, wherein said raising structure presents a general strip formation with two vertical branches that rise above said mobile wall and terminate with said at least one grip formation.

2. Base according to claim 1, characterised in that said at least one grip formation is in the form of handles.

3. Base according to claim 2, characterised in that said raising structure presents a general strip conformation with a core portion that extends below said mobile wall.

4. Base for display units comprising a box-shaped body with a lateral wall extending between a bottom part and a top part of said box-shaped body, the base also including a mobile wall to support said display units selectively mobile between:

a lowered position, in which said mobile wall is situated in correspondence with said bottom part and said base is capable of acting as a container for a display unit, and a raised position in which said mobile wall is situated in correspondence with said top part and is capable of supporting a display unit in the exhibiting position, wherein said base includes, associated to the bottom part of said box-shaped body, foot-shaped formations that can selectively be deployed from a folded position against said box-shaped body towards an extended position in which said foot-shaped formations are capable of maintaining said box-shaped body in a raised position with regard to the ground.

5. Base according to claim 4, characterised in that said foot-shaped formations comprise a foldable tubular element with a parallelogram section and presenting, in a part of said parallelogram, at least one cut-out flap formation foldable inwards with regard to said tubular element to block said tubular element in its deployed position.

6. Base according to claim 5, characterised in that said cut-out flap formation is cut out from a wall of said tubular element facing outward with regard to said box-like body, such that, when folded into said tubular element, said at least one flap forms a cavity accessible from the outside to hold the respective foot-shaped formation in a condition in which it rests on the ground.

* * * * *